US008678571B2

(12) United States Patent
Wagner et al.

(10) Patent No.: US 8,678,571 B2
(45) Date of Patent: Mar. 25, 2014

(54) FLUID EJECTION CARTRIDGE

(75) Inventors: William R. Wagner, Escondido, CA (US); Donald B Ouchida, Corvallis, OR (US); Daniel S Kuehler, San Diego, CA (US); John Liebeskind, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 145 days.

(21) Appl. No.: 13/121,719

(22) PCT Filed: Oct. 15, 2008

(86) PCT No.: PCT/US2008/079994

§ 371 (c)(1),
(2), (4) Date: Mar. 30, 2011

(87) PCT Pub. No.: WO2010/044788

PCT Pub. Date: Apr. 22, 2010

(65) Prior Publication Data

US 2011/0181672 A1 Jul. 28, 2011

(51) Int. Cl.
*B41J 2/175* (2006.01)

(52) U.S. Cl.
USPC ..... 347/86; 347/66; 347/85

(58) Field of Classification Search
USPC ..... 347/84–86, 66
See application file for complete search history.

(56) References Cited

U.S. PATENT DOCUMENTS

| | | | | |
|---|---|---|---|---|
| 5,119,115 | A * | 6/1992 | Buat et al. | 347/86 |
| 5,555,007 | A | 9/1996 | Ceschin et al. | |
| 5,988,803 | A * | 11/1999 | Komplin et al. | 347/86 |
| 6,145,973 | A | 11/2000 | Wu et al. | |
| 6,264,316 | B1 | 7/2001 | Chino | |
| 6,416,152 | B1 * | 7/2002 | Matsuzaki et al. | 347/19 |
| 6,692,118 | B2 | 2/2004 | Michele et al. | |
| 6,854,835 | B2 * | 2/2005 | Kobayashi et al. | 347/85 |
| 7,195,345 | B2 * | 3/2007 | Shinada et al. | 347/85 |
| 2003/0063168 | A1 | 4/2003 | Kobayashi et al. | |
| 2006/0071989 | A1 | 4/2006 | Lewey et al. | |

FOREIGN PATENT DOCUMENTS

JP 63009547 A 1/1988

* cited by examiner

*Primary Examiner* — Ellen Kim

(57) ABSTRACT

A fluid ejection cartridge for a fluid ejection device includes a print head, having a plurality of fluid ejection nozzles, a fluid reservoir, configured to hold a fluid to be ejected from the print head, and a selectively breachable isolator mechanism, separating the fluid reservoir and the print head.

10 Claims, 8 Drawing Sheets

FLUID EJECTION CARTRIDGE

BACKGROUND

The materials that are used in inkjet print heads are generally resistant to water-based fluids, such as are used in many consumer and business applications. However, in some applications, inks or other fluids formulated with organic solvents are often used. These organic solvents can have a negative effect on internal print head materials, including structural materials, adhesives, and barrier films, potentially causing these materials to swell, soften, or dissolve, for example, eventually compromising the function of the device and leading to its premature failure. In some cases, these failures can happen in a matter of hours after the ink or other fluid initially comes into contact with the print head materials. This can complicate shipping and storage of these types of print heads.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
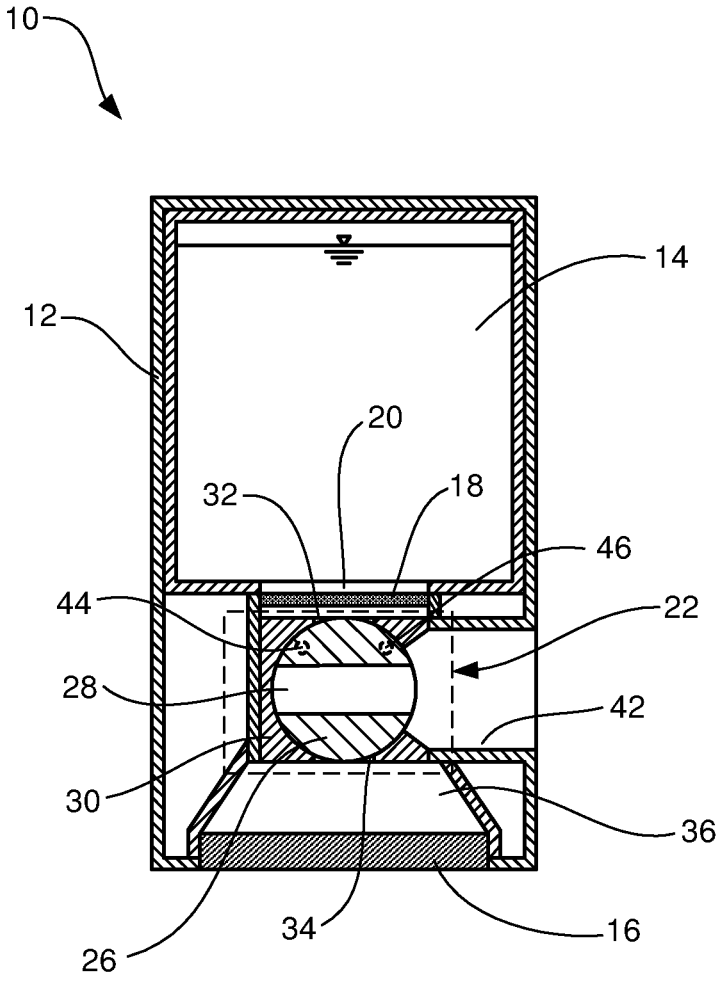
FIG. 1 is a cross-sectional view of an embodiment of a fluid ejection cartridge having a rotary valve-type isolator mechanism between the fluid supply and the print head, the valve being in the closed position.

Reference will now be made to exemplary embodiments illustrated in the drawings, and specific language will be used herein to describe the same. As used herein, directional terms, such as "top," "bottom," "front," "back," "leading," "trailing," etc, are used with reference to the orientation of the figures being described. Because components of various embodiments disclosed herein can be positioned in a number of different orientations, the directional terminology is used for illustrative purposes only, and is not intended to be limiting. It is also to be understood that the exemplary embodiments illustrated in the drawings, and the specific language used herein to describe the same are not intended to limit the scope of the present disclosure. Alterations and further modifications of the features illustrated herein, and additional applications of the principles illustrated herein, which would occur to one skilled in the relevant art and having possession of this disclosure, are to be considered within the scope of this disclosure.

As used herein, the term "fluid ejection device" is intended to refer generally to any drop-on-demand fluid ejection system, and the terms "ink jet", "print head" and "printer" are intended to refer to the same type of system or components thereof that are used for ejecting fluids onto substrates such as (but not limited to) print media, for producing visible indicia or for other purposes. Such systems can include thermal ink jet and piezo-electric ink jet technology. It is to be understood that where the description presented herein depicts or discusses an embodiment of an ink jet printing system, this is only one embodiment of a drop-on-demand fluid ejection system that can be configured in accordance with the present disclosure.

Where this disclosure refers to "ink", that term is to be understood as just one example of a fluid that can be ejected from a drop-on-demand fluid ejection device in accordance with this disclosure. Many different kinds of liquid fluids can be ejected from drop-on-demand fluid ejection systems, such as food products, chemicals, pharmaceutical compounds, fuels, etc. The term "ink" is therefore not intended to limit the system to ink, but is only exemplary of a liquid that can be used. Additionally, the terms "print" or "printing" and "ink jet" are intended to generally refer to fluid ejection onto any substrate for any purpose, and are not limited to providing visible images on paper or the like.

The terms "unitary print cartridge" and "unitary cartridge" refer to a print cartridge in which the ink reservoir and print head are contained within a single replaceable body or unit.

Inkjet printing systems are a type of fluid ejection device and generally include a print head and an ink supply that provides liquid ink to the print head. The print head is a semiconductor device and includes a print head die with a plurality of orifices or nozzles fabricated on a semiconductor substrate, along with circuitry for addressing the nozzles in response to signals from a controller device to selectively eject ink drops from the nozzles.

Many inkjet printing systems include a unitary print cartridge, which can be desirable in many instances because of simplicity of design (fewer parts and connections) and end user ease of use (fewer connections, replacement ease, less risk of ink leakage and spill). Many unitary ink supply/print head designs that currently exist are supplied to the user with the print head filled with ink, the ink being in contact with the print head internal fluid architecture. This is suitable when using inks or other fluids that do not cause chemical and/or physical instability of print head materials.

As noted above, the materials used in inkjet print heads are generally resistant to water-based inks that are used in most consumer and business applications. In industrial printing applications, however, inks that are formulated with organic solvents are frequently used. These solvents, including ketones, such as acetone and methyl ethyl ketone, acetates such as ethyl acetate, toluene, acetonitrile, tetrahydrofuran (THF), dimethyl sulfoxide, (DMSO), chloroform, methylene chloride and alcohols such as ethanol, often in combination, can have a negative impact on internal print head materials, including structural materials, adhesives, and barrier films. Additionally, fluids other than ink can be ejected from drop-on-demand fluid ejection systems, including food products, chemicals, pharmaceutical compounds, fuels, etc., and these fluids can also include organic solvents or other constituents that are potentially harmful to the internal components of the fluid ejection device. Organic solvents can cause the print head materials to swell, soften, or dissolve, eventually compromising the function of the device and leading to its failure. In some cases, these failures can happen in a matter of hours after initial filling of the print head fluid passageways. Over time, exposure can lead to failures such as seal failures, die delamination, barrier failure, or failure of the photoresist polymer on the die, such as over the ink-feed slot or near the nozzles.

In many industrial applications, it is not intended for the print head to have a long working life, but only to operate effectively and predictably long enough to satisfy workflow and economic requirements. As such, even if damage to the internal print head materials starts immediately after ink is introduced, as long as the print head functions for an acceptable and predictable period of time before failing, the product can be successful. However, the incompatibility of the solvents in the fluid can make shipping and storing the fluid in contact with an integrated silicon print head impractical, since degradation can occur in a short time, sometimes within hours.

Because of the materials often used in thermal inkjet print heads, it can often be impractical to print with organic solvent inks, inks containing water in combination with organic solvents, or other non-water-based fluids when using these print heads unless the exposure of the print head to the fluid to be ejected is prevented until immediately before use. The inability of some thermal inkjet print heads to be used with organic solvent inks or other non-water-based fluids limits a wider utility of this technology in some industrial applications. Developing a print head that is chemically inert to the range of substances used in industrial inks and other fluids can be difficult, costly and impractical in some situations.

Advantageously, a unitary print cartridge has been developed in which the print head and ink are kept isolated until just before use. By keeping the print head materials and ink or other fluid separated until the print head is to be installed in the printer for use, the working life of the cartridge can be separated from its shelf life, thus lengthening the shelf life of the cartridge and making its operation more predictable and economical.

Shown in FIG. 1 is a cross-sectional view of one embodiment of a fluid ejection cartridge with an isolator mechanism disposed between the fluid supply and the print head. The print cartridge 10 generally includes an outer housing 12, which contains a fluid reservoir 14 and a print head 16. The print head contains internal fluidic channels, nozzles, and the electronic and physical mechanisms used to eject ink drops. The ink supply reservoir is the structure that holds the ink, commonly using any of a variety of structures such as bags, bladders, and sponges, and in use feeds ink to the print head fluidic channels via a fluid manifold 36. The fluid reservoir can be part of a pressure-regulated fluid supply. A filter screen or capillary valve 18 can be located at the outlet 20 of the fluid reservoir 14.

The ink supply can be constructed of materials with long-term stability while in direct contact with the ink or other fluid. The print head, however, is of inherently more complex design and may contain a material or materials with only limited chemical or physical stability once in contact with chemicals in the ink or other fluid. Advantageously, disposed between the fluid reservoir 14 and the print head 16 is an isolator mechanism, indicated by the dashed outline 22, which is configured to keep the ink separated from the print head 16 until just before first use. As shown in the embodiment of FIG. 1, the isolator mechanism 22 is a rotary-type valve, having a rotatable cylinder or ball 26 with a fluid aperture 28 extending therethrough. The ball is held within a housing 30, in which it can slidingly rotate when desired by a user. In the configuration of FIG. 1, it can be seen that the rotary valve is in the closed position, with the solid portions of the ball positioned adjacent to (and thereby blocking) the fluid inlet 32 and outlet 34 of the valve.

Figure 2:
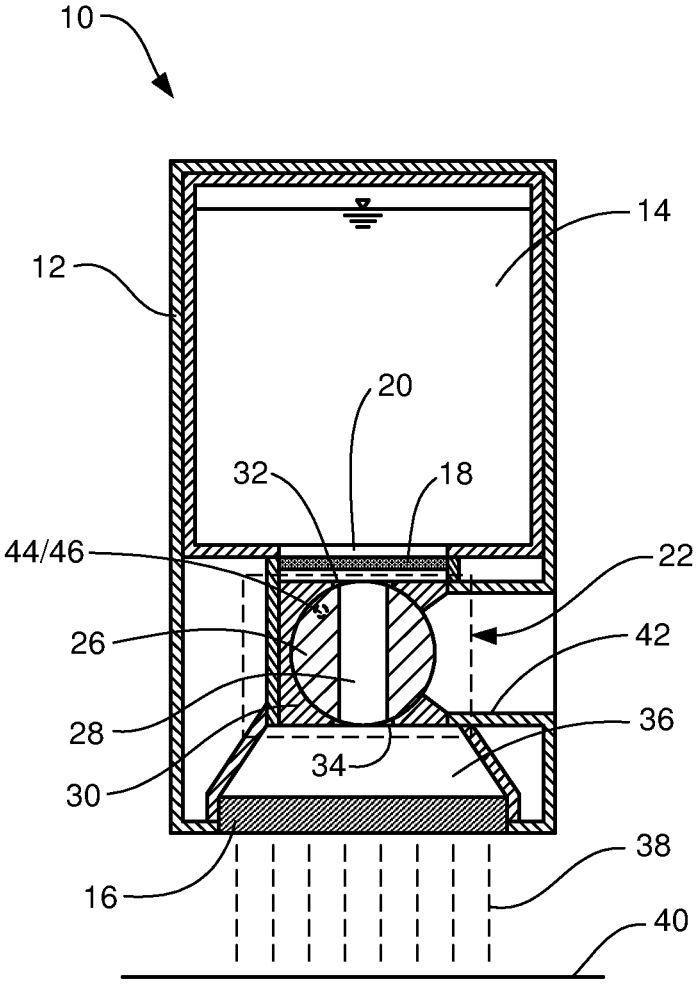
FIG. 2 is a cross-sectional view of the fluid ejection cartridge of FIG. 1, with the valve in the open position.

However, as shown in FIG. 2, the valve 22 can be rotated to an open position, in which the fluid aperture 28 aligns with the valve inlet 32 and valve outlet 34, thus allowing fluid to flow from the reservoir 14 into a fluid manifold 36 that feeds the print head 16. The print head includes fluid passageways and fluid ejection nozzles (not shown) that allow fluid to be drawn from the manifold 36 and ejected as a series of droplets 38 onto a substrate 40. The shape and size of the fluid aperture 28 can vary. However, it is desirable that the fluid aperture be configured to accommodate a flow of fluid from the reservoir 14 to the fluid manifold 36 sufficient to meet the fluid demand of the print head 16.

Any of a wide variety of mechanisms can be used to rotate the valve 22 when desired. The opening of the valve can be accomplished by either manual or automatic means. In a manual design, the valve can have a mechanical device (e.g. a knob, lever, slot, etc.) that communicates with the outside of the cartridge, so that the valve can be opened by a user turning a knob, pulling or depressing a tab or button, tightening a screw, inserting a key, etc. In the embodiment of FIGS. 1 and 2, a finger recess 42 is provided in a side of the housing 12 of the fluid ejection cartridge 10, allowing a user to manually rotate the valve to the open position by inserting one or two fingers into the finger recess to contact the ball or cylinder 26 and rotate it. However, many other mechanisms can be provided for rotating the valve, whether rotating, sliding, etc., and any such mechanism is intended to be encompassed within the present disclosure. For example, the rotatable element 26 of the valve can be a cylinder that axially extends to and is exposed on one end of the print cartridge, to enable mechanical rotation.

In one embodiment, the valve mechanism can be held in place by friction. Alternatively, a position fixing mechanism can also be provided to hold the cylinder or ball 26 in either or both of the open and closed positions. For example, as shown in dashed lines in FIGS. 1 and 2, a detent mechanism can include a detent pin 44 that is part of the housing 30, with a detent recess 46 that is part of the cylinder or ball. When the valve is in the closed position, as shown in FIG. 1, the detent pin 44 and detent recess 46 are misaligned. However, when the valve is rotated to the open position, shown in FIG. 2, these two structures line up, causing the detent pin to resiliently snap into the detent recess, thus holding the valve in the open position. This configuration thus indicates proper alignment of the valve when in the open position, and also helps to keep the valve in the open position.

The position fixing mechanism can have multiple stops. For example, a detent mechanism can be used that has a first stop position when the valve is in the closed position, and a second stop position when the valve is in the open position (as illustrated in FIGS. 1 and 2). Other stop positions can also be provided. Additionally, the position fixing mechanism can be a one-way or two way device. In a one-way embodiment, the valve is to be opened only once for use of the fluid cartridge, and the position fixing mechanism locks the valve in the open position once it is moved there, preventing the user from reversing the opening move. Alternatively, the position fixing mechanism can be a two-way device, allowing a user to close the valve after it has been opened. This can be useful where the valve is inadvertently opened.

Figure 3:
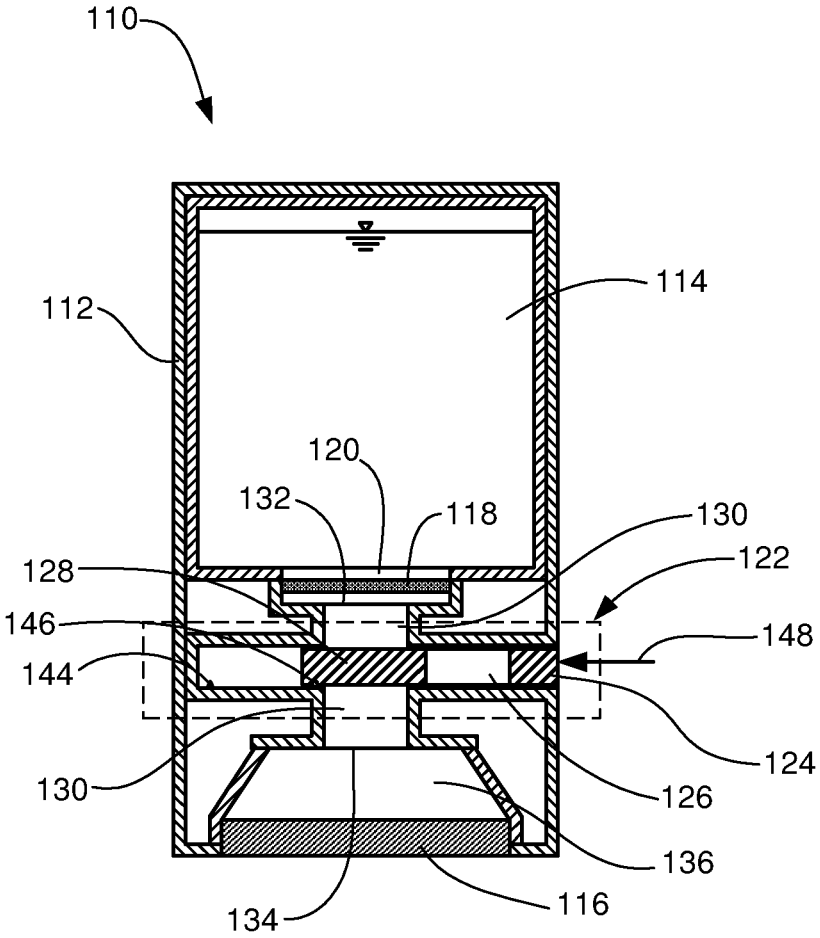
FIG. 3 is a cross-sectional view of an embodiment of fluid ejection cartridge having a slide valve-type isolator mechanism between the fluid supply and the print head, the valve being in the closed position.
Figure 4:
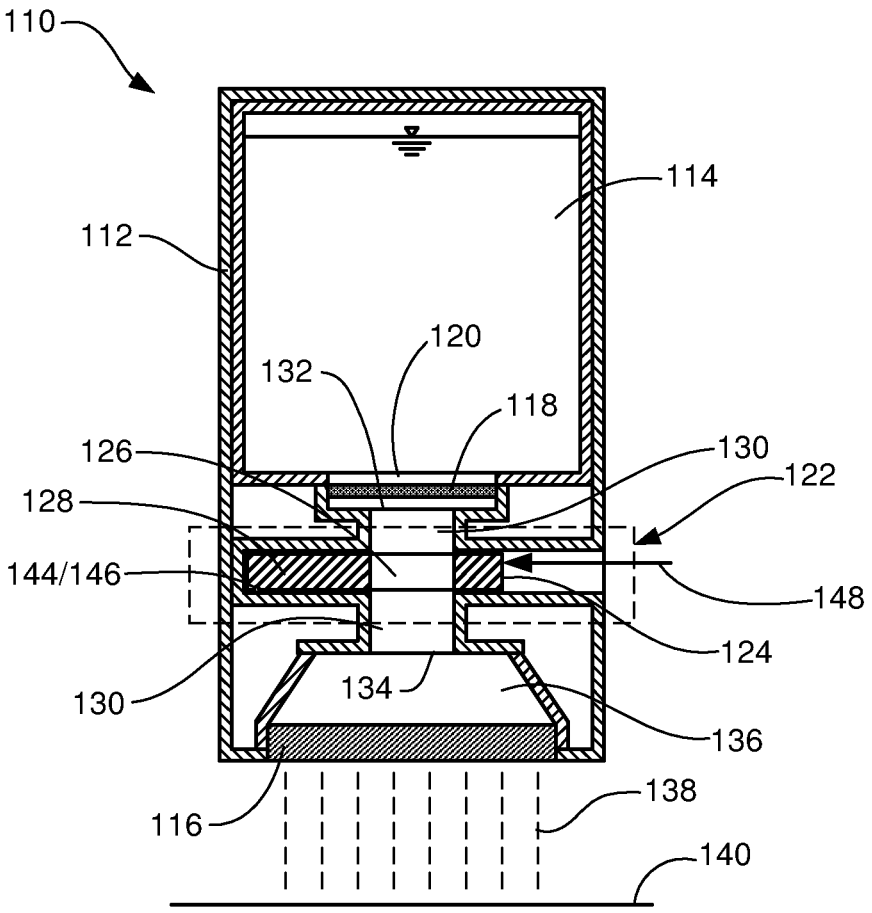
FIG. 4 is a cross-sectional view of the fluid ejection cartridge of FIG. 3, with the valve in the open position.

Another embodiment of a fluid ejection cartridge with an isolator mechanism is shown in the cross-sectional views of FIGS. 3 and 4. This embodiment is similar in many respects to that shown in FIGS. 1 and 2. The print cartridge 110 generally includes an outer housing 112, which contains a fluid reservoir 114 and a print head 116. A filter screen or capillary valve 118 is located at the outlet 120 of the fluid reservoir 114, and leads into a standpipe 130 that connects the fluid reservoir with the fluid manifold 136, which feeds the print head 116.

An isolator mechanism, indicated generally by the dashed outline 122, is provided in the standpipe 130, between the outlet 120 of the reservoir and the fluid manifold 136. In this embodiment the isolator mechanism is a slide-type valve, having a slide 124 with a fluid aperture 126 extending therethrough. In the configuration of FIG. 3, it can be seen that the slide is in the closed position, with a forward solid portion 128 of the slide positioned adjacent to (and thereby blocking) the fluid inlet 132 and outlet 134 of the standpipe 130. In this position, a rearward portion 130 of the slide is substantially flush with the side of the cartridge housing 112. This configuration helps shield the slide from being unintentionally bumped or moved. This rearward portion of the slide is provided to allow a user to manually push the slide into the housing, in the direction of arrow 148, to open the valve. It is to be appreciated that many other mechanisms for moving the slide valve from a closed position to an open position can also be used. Moving to FIG. 4, once the slide 124 is pushed into the housing, moving the valve to an open position, the fluid aperture 126 aligns with the inlet 132 and outlet 134 of the standpipe 121, thus allowing fluid to flow from the reservoir 114 into the fluid manifold 136, allowing fluid to fill the standpipe 130, manifold 136, and print head 116 and to be ejected from fluid ejection nozzles (not shown) of the print head 116 onto a substrate 140 as a series of droplets 138 when the print head is activated by a control signal.

Figure 5:
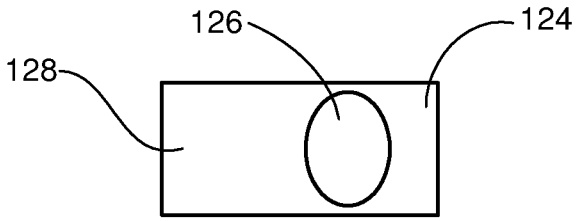
FIG. 5 is a top view of one embodiment of a slide that can be used with the slide valve-type isolator mechanism of the fluid ejection cartridge embodiment of FIG. 3.

The views of FIGS. 3 and 4 show the slide 124 in a side view. Provided FIG. 5 is a top view of one embodiment of a slide 124 that can be used with the slide valve-type isolator mechanism 122 of the fluid ejection cartridge embodiment of FIGS. 3 and 4. The slide 124 can be a substantially solid rectangular body 150 of polymer material, for example, with the fluid aperture 126 in a generally central location. The aperture can be almost any shape. However, as noted above, it is desirable that the fluid aperture be configured to accommodate a flow of fluid from the reservoir 114 to the fluid manifold 136 sufficient to meet the fluid demand of the print head 116. In the embodiment of FIG. 5, the fluid aperture 126 is generally elliptical in shape. However, other shapes can also be used.

As with the rotary valve embodiment, a position fixing mechanism can be associated with the slide valve 122 to hold it in either or both of the open and closed positions. For example, as shown in FIGS. 3 and 4, a detent mechanism can be provided that includes a detent pin 144 that is part of the cartridge, with a detent recess 146 provided in the slide 124. When the slide is in the closed position, as shown in FIG. 3, the detent pin 144 and detent recess 146 are misaligned. However, when the slide is moved to the open position, shown in FIG. 4, these two structures line up, causing the detent pin to resiliently snap into the detent recess, thus holding the valve in the open position. As discussed above with respect to the rotary valve embodiment, the position fixing mechanism for the slide valve can have multiple stops, and can be a one-way or two way device.

Figure 6:
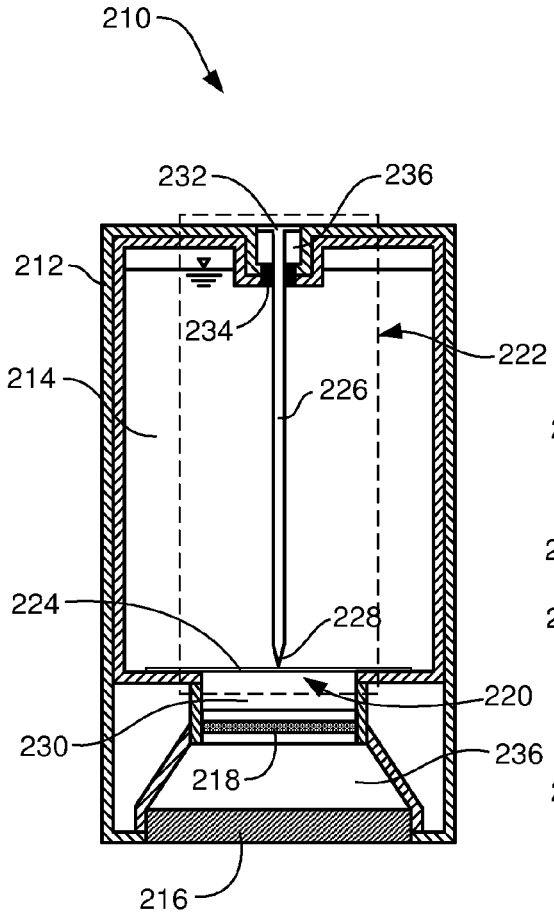
FIG. 6 is a cross-sectional view of an embodiment of a fluid ejection cartridge having a breachable membrane-type isolator mechanism with a downwardly extending breaching pin for puncturing the membrane.
Figure 7:
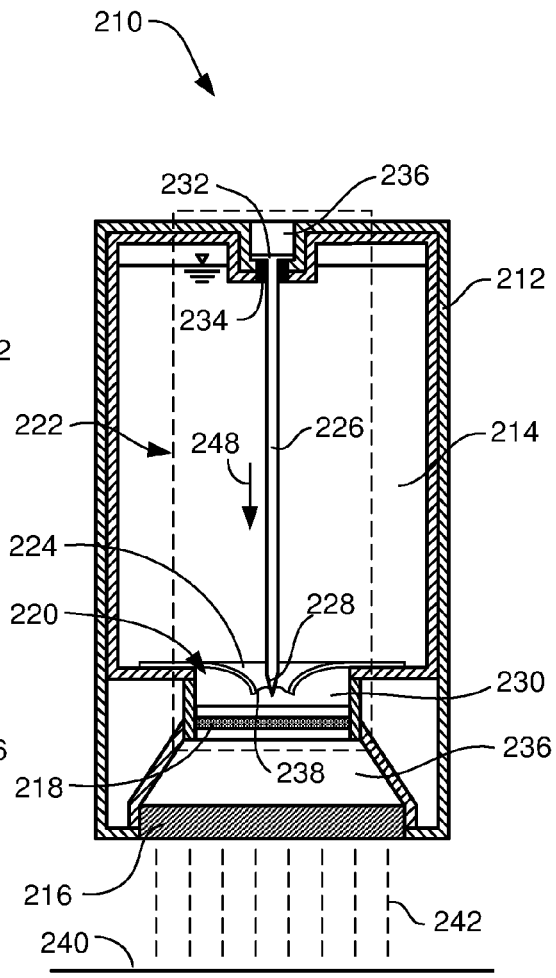
FIG. 7 is a cross-sectional view of the fluid ejection cartridge of FIG. 6, with the membrane having been breached by the breaching pin.

In addition to valve-type devices, print cartridges can also be provided with a breachable or pierceable membrane to isolate the fluid supply from the print head before use. Shown in FIGS. 6 and 7 are cross-sectional views of an embodiment of a fluid ejection cartridge having a breachable membrane-type isolator mechanism. This embodiment is similar in many respects to those shown in FIGS. 1-2 and 3-4. The print cartridge 210 generally includes an outer housing 212, which contains a fluid reservoir 214 and a print head 216. A filter screen or capillary valve 218 is located at the outlet 220 of the fluid reservoir 214, and leads into a standpipe 230 that connects the fluid reservoir with the fluid manifold 236, which feeds the print head 216.

The isolator mechanism in this embodiment, indicated generally by the dashed outline 222, comprises a breachable membrane 224, with a moveable breaching pin 226 positioned with its point 228 adjacent to the membrane. The membrane, which can be elastic or inelastic, isolates the fluid in the reservoir 214 from the print head 216 prior to use of the print cartridge 210. The breaching pin extends downwardly through the fluid reservoir 214, and includes a plunger head 232 that is exposed at the top of the outer housing 212 of the print cartridge 210. A seal 234 is provided around the upper portion of the breaching pin to maintain the integrity of the fluid reservoir, while also allowing the breaching pin to slide. In the configuration of FIG. 6, it can be seen that the point 228 of the breaching pin is above the membrane 224, so that the membrane is intact, thus preventing fluid from the reservoir from flowing into the standpipe 230 and other regions below. In this position, the plunger head 232 is substantially flush with the top of the cartridge housing 212. This configuration helps shield the plunger head from being unintentionally bumped or moved.

The breaching pin 226 is just one of many possible embodiments of a piercing or cutting member that is positioned to breach the membrane with the application of force. The force required to cause the piercing or cutting member to move against the membrane can be applied either manually or automatically. In a manual design, the piercing or cutting member can be in communication with the outside of the cartridge, with force applied to it by actions such as pushing a button, tightening a screw, or depressing a plunger. This action causes the piercing or cutting member to move toward and breach the membrane, allowing the ink to flow into the print head fluidic structures.

In the embodiment of FIGS. 6 and 7, the cutting member is configured for either manual or automatic application of force for breaching the membrane 224. A user can manually push the plunger head 232 downwardly into a plunger recess 236, thereby pushing the breaching pin 226 downward through the fluid reservoir 224, in the direction of arrow 248, to pierce the membrane 224. Alternatively, a plunger mechanism associated with the control unit (not shown) for the print cartridge can be configured to mechanically push the plunger after the cartridge is mounted in the control unit. Other mechanisms for depressing the plunger can also be used.

FIG. 7 depicts the plunger and breaching pin in the depressed position. When the plunger head is pushed downwardly, this pushes the point 228 of the breaching pin against and through the membrane, creating an opening 238. Once the breaching pin 226 breaches the membrane, fluid can flow from the reservoir 214, through the standpipe 230, and into the fluid manifold 236, allowing fluid to fill the standpipe 230, manifold 236, and print head 216 and to be ejected from fluid ejection nozzles (not shown) of the print head 216 onto a substrate 240 as a series of droplets 238 when the print head is activated by a control signal. As discussed below, the standpipe and other fluid passageways outside the fluid reservoir can be initially filled with a keeper fluid, which can be removed by the application of vacuum pressure after the membrane is breached, thus drawing the fluid to be ejected into the print head fluid architecture. This feature can be associated with all of the embodiments shown and described herein.

The plunger 232 can be designed to remain in the downward position within the plunger recess 236 after it is depressed, thus providing a visual indication to a user that the membrane 224 has been breached. Alternatively, the plunger can be spring-loaded or provided with some other mechanism for raising it after it is depressed, so that the point 228 of the breaching pin 226 is removed from the opening 238 in the membrane, thereby not obstructing flow of the fluid.

A fluid ejection cartridge in accordance with the present disclosure having a breachable membrane can also be configured without an internal membrane cutting mechanism. That is, the cartridge can be configured so that the breachable membrane can be breached by the insertion of a cutting member from outside the cartridge. For example, the embodiment of FIGS. 6 and 7 can be configured with the breaching pin 226 separate from the fluid ejection cartridge 210, the breaching pin being insertable through the seal 234 to breach the membrane 224 when desired by a user. In this embodiment the seal 234 can be configured as a port in the top of the cartridge body. This port can be configured like a fluid injection port similar to those that can be used to fill the fluid reservoir at the time of manufacture of the cartridge. The port provides a resilient seal, and the fluid is introduced into the reservoir by inserting a small filler tube or needle (not shown) through the port seal and into the reservoir, allowing the flow of fluid. Once the reservoir is filled, the tube is removed. Depending on the resilience of the seal material, the seal may close sufficiently by itself after removal of the filler tube. Alternatively, a plug such as a stainless steel ball can be placed in the hole and held in place (e.g by an adhesive strip, a mechanical cap, etc.). An example of a refill port though which a needle may be inserted is disclosed in U.S. Pat. No. 5,929,883, the disclosure of which is hereby incorporated by reference, particularly the disclosure related to FIGS. 5-8 therein.

This configuration can be used where the fluid reservoir is filled at manufacture and shipped with fluid therein, or the cartridge can be shipped empty, and the user can fill the reservoir from their own supply of fluid using a filler tube when it is desired to use the cartridge. In either case, after the reservoir is filled, just prior to using the cartridge the user can insert the breaching pin 226 (or some other comparable cutting device) through the port seal 234 to breach the membrane 224, as discussed above. At this point the breaching pin can be removed from the print head cartridge, allowing the port seal 234 to reseal itself, or the user can reinsert the plug, and the cartridge is ready for use. Other configurations that use a separate breaching member that is inserted from outside the cartridge, rather than an internal membrane cutting mechanism, can also be used.

Figure 8:
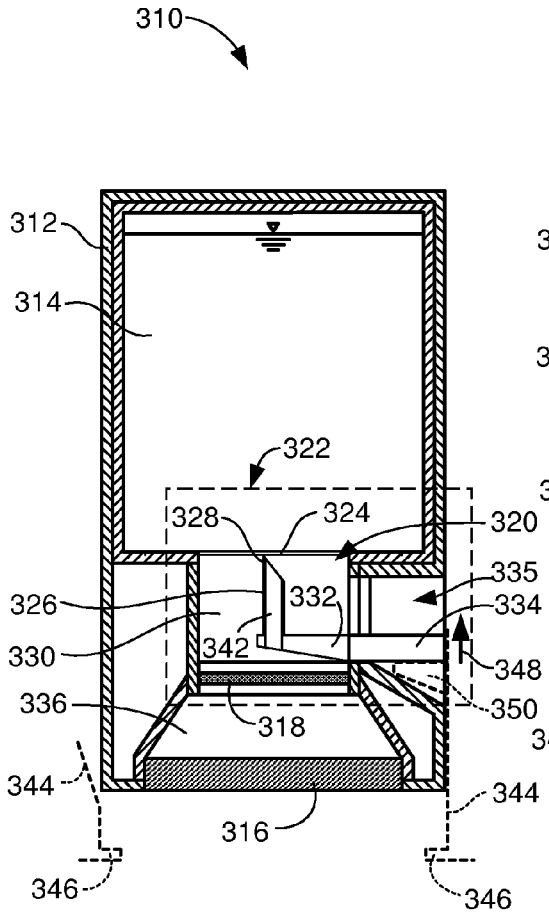
FIG. 8 is a cross-sectional view of another embodiment of a fluid ejection cartridge having a breachable membrane-type isolator mechanism with an upwardly sliding breaching pin for breaching the membrane.
Figure 9:
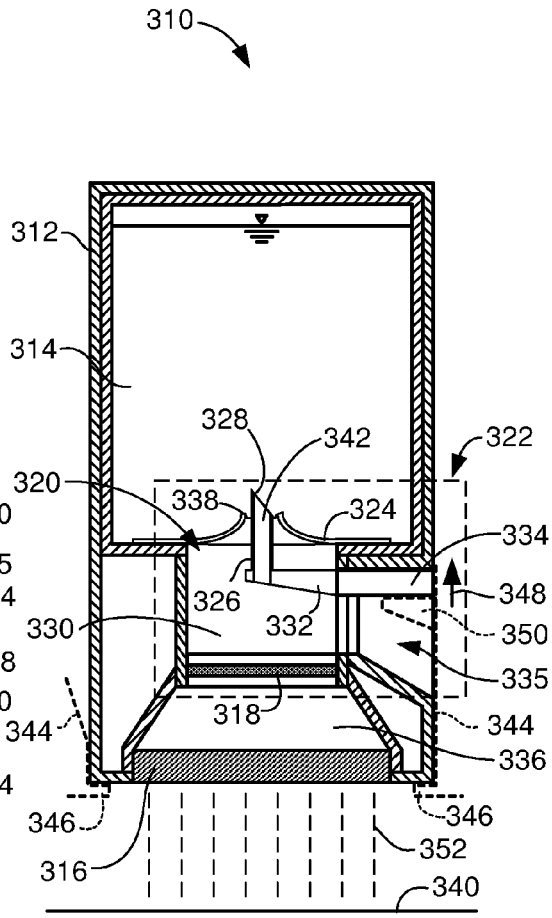
FIG. 9 is a cross-sectional view of the fluid ejection cartridge of FIG. 8, with the membrane having been breached.

It is to be appreciated that the mechanism shown in FIGS. 6 and 7 is only one mechanism for piercing the membrane, and that a variety of other mechanisms can also be used. For example, shown in FIGS. 8 and 9 are cross-sectional views of another embodiment of a fluid ejection cartridge having a breachable membrane-type isolator mechanism. This embodiment is similar in many respects to that shown in FIGS. 6-7, except that rather than piercing the membrane downwardly from within the fluid reservoir, this embodiment pierces the membrane upwardly from below the reservoir. The print cartridge 310 generally includes an outer housing 312, which contains a fluid reservoir 314 and a print head 316. A filter screen or capillary valve 318 is located at the outlet 320 of the fluid reservoir 314, and leads into a standpipe 330 that connects the fluid reservoir with the fluid manifold 336, which feeds the print head 316.

The isolator mechanism in this embodiment, indicated generally by the dashed outline 322, comprises a breachable membrane 324, with a moveable breaching pin 326 positioned with its point 328 adjacent to and below the membrane. The breaching pin is located within the standpipe 330, and is attached to a slide 332 that has a lever end 334 that is exposed in a side recess 335 of the outer housing 312. In the configuration of FIG. 8, it can be seen that the membrane is intact, thus preventing fluid from the reservoir from flowing into the standpipe 330 and other regions below. In this position, the lever end 334 of the slide 332 is in a down position within the side recess 335.

As noted above, the force required to cause the piercing or cutting member (the breaching pin 326) to move against the membrane 324 can be applied either manually or automatically. In the embodiment of FIGS. 8 and 9, the cutting member is configured for either manual or automatic application of force for breaching the membrane. For example, a user can manually push the lever end 334 of the slide 332 upward, in the direction of arrow 348, causing the point 328 of the breaching pin to move upward and pierce the membrane 324, creating an opening 338.

Alternatively, the lever end of the slide 332 can be pushed upward relative to the body 312 of the cartridge 310 by the action of inserting the cartridge into a receiving structure. For example, the print cartridge can be configured to fit into a receiving mount, indicated by dashed lines 344. The receiving mount is associated with the printer device, and includes a bottom shoulder 346 and a ledge 350 extending from one side. To install the print cartridge in the printer device, a user inserts the cartridge downward and from one side (e.g. the left side in FIG. 8) so that the ledge 350 inserts into the side recess 335 of the cartridge body and below the lever end 334 of the slide 332. As the user slides the cartridge down into the receiving mount, the ledge pushes the lever up, in the direction of arrow 348, thus piercing the membrane as the cartridge comes to rest against the lower shoulders 346 of the mount. In this way the membrane is automatically pierced as the print cartridge is installed for use in a printer device.

Once the breaching pin 326 breaches the membrane, fluid can flow from the reservoir 314, through the standpipe 330, and into the fluid manifold 336, allowing fluid to be ejected from fluid ejection nozzles (not shown) of the print head 316 onto a substrate 340 as a series of droplets 352 once the print head is activated by a control signal.

The slide 332 can be configured to remain in the raised position (shown in FIG. 9) after the membrane 324 is pierced (e.g. by friction or the provision of a detent or other mechanism to hold it in place), or it can be retracted downward to its original position (shown in FIG. 8). Retraction of the breaching pin after piercing of the membrane can help promote fluid flow, while keeping the slide in the raised position can help provide a visual indication that the membrane has been breached.

As shown in FIG. 9, the breaching pin 326 can be hollow, having a central aperture 342 extending completely therethrough. This aperture can help promote the flow of fluid from the reservoir 314, even if the breaching pin substantially completely occupies the opening 338 in the membrane after the membrane has been pierced. As discussed below, the standpipe and other fluid passageways outside the fluid reservoir can be initially filled with a keeper fluid, which can be removed by the application of vacuum pressure after the membrane is breached, thus drawing the fluid to be ejected into the print head fluid architecture.

Figure 10:
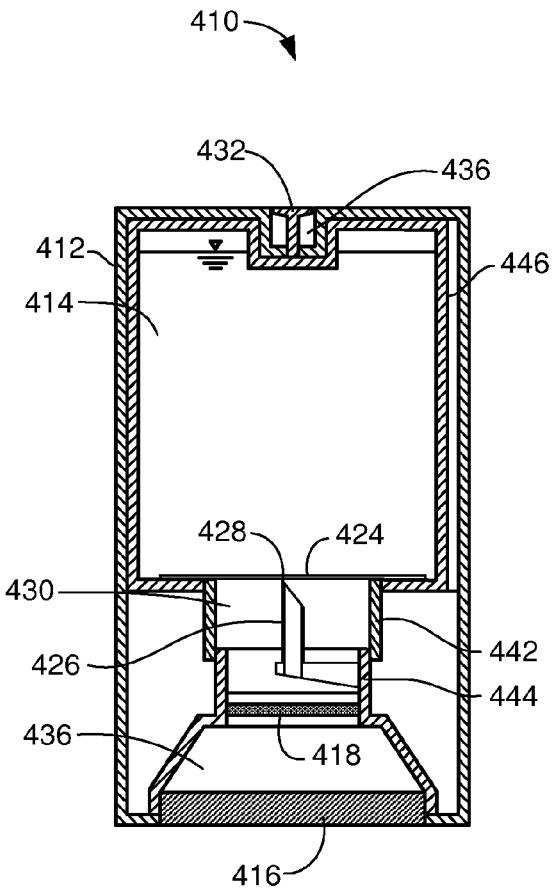
FIG. 10 is a cross-sectional view of another embodiment of a fluid ejection cartridge having a breachable membrane-type isolator mechanism with a fixed breaching pin and a moveable fluid reservoir.
Figure 11:
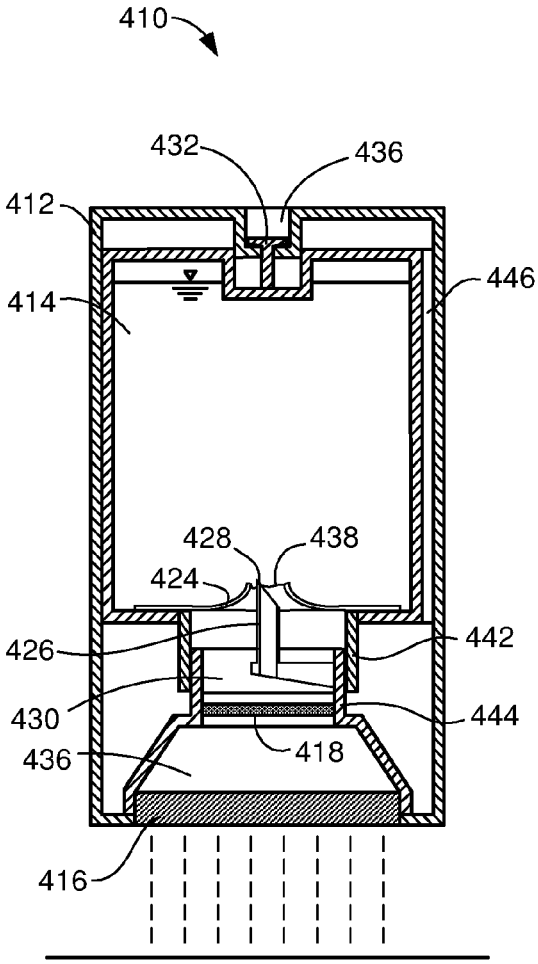
FIG. 11 is a cross-sectional view of the fluid ejection cartridge of FIG. 10, with the reservoir having been moved downward and the membrane breached.

Another embodiment of a print cartridge 410 having an isolated fluid supply in which the membrane is pierced from below is shown in FIGS. 10 and 11. This embodiment is similar to that of FIGS. 8 and 9, except that the breaching pin 426 is in a fixed location with respect to the outer housing 412 of the cartridge, while the fluid reservoir 414 is moveable within the housing. In this embodiment a plunger 432 is located within a recess 436 at the top of the cartridge housing, and is connected to the top of the reservoir. When a user pushes on the plunger, this pushes the entire reservoir downward, causing the breachable membrane 424 to press against the point 428 of the breaching pin 426, thereby cutting an opening 438 in the membrane. This condition is shown in FIG. 11. This allows fluid from the reservoir to flow into the standpipe 430, and thence through a filter screen or capillary valve 418 and into the fluid manifold 436, which feeds the print head 416.

In the embodiment of FIGS. 10 and 11, the standpipe 430 can be configured with telescoping portions 442, 444, which allow the position of the reservoir 414 to shift downward while maintaining the integrity of the standpipe. The cartridge can also include an air passageway 446 within the cartridge housing 412 to allow air to pass around the fluid reservoir as it is pushed down.

Figure 12:
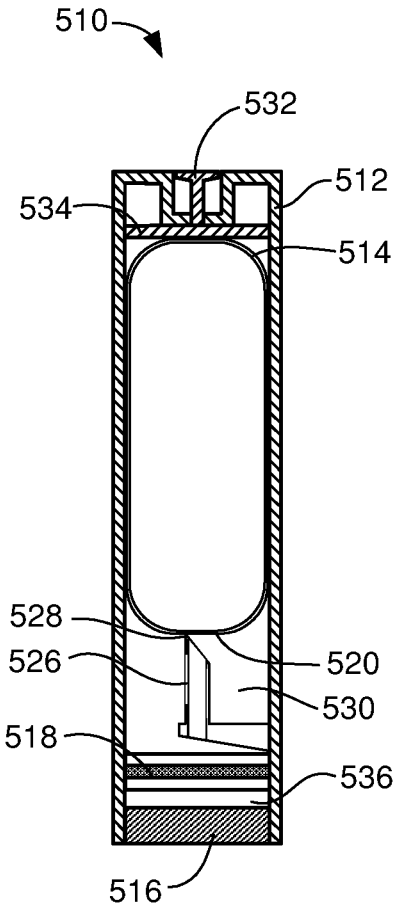
FIG. 12 is a cross-sectional view of another embodiment of a fluid ejection cartridge having a flexible and moveable fluid reservoir.
Figure 13:
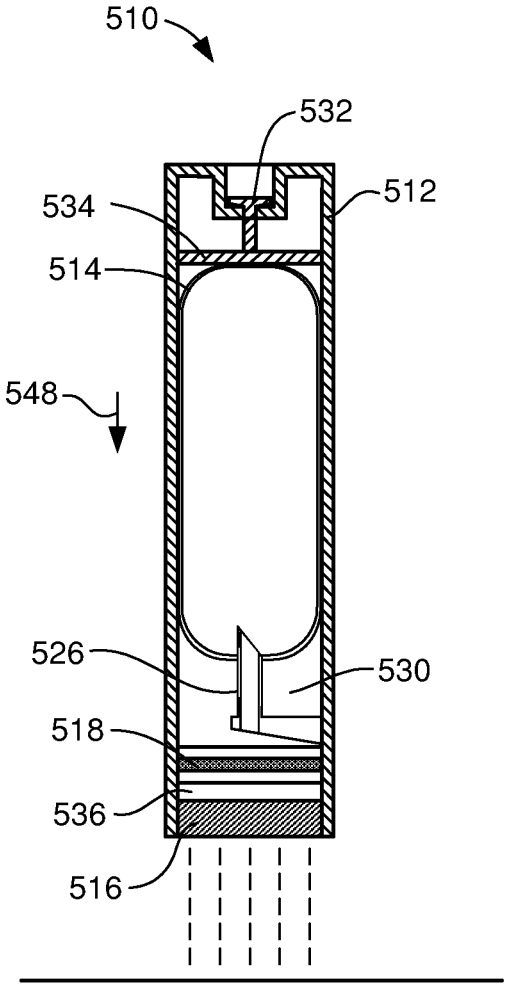
FIG. 13 is a cross-sectional view of the fluid ejection cartridge of FIG. 12, with the reservoir having been moved downward and the membrane breached.

While the embodiment of FIGS. 10 and 11 is shown with a substantially rigid fluid reservoir, this sort of embodiment can also be configured with a flexible fluid reservoir. Such an embodiment is shown in FIGS. 12 and 13. In this embodiment, the cartridge 510 includes a reservoir 514 that is a flexible bag, contained within the housing 512. The plunger 532 is connected to a relatively rigid panel 534 that is positioned above and against the reservoir, inside the housing. A lower end 520 of the reservoir is positioned near the point 528 of the breaching pin 526. When the plunger is depressed, this causes the flexible reservoir to slide or flex downward within the housing, in the direction of arrow 548, to be pierced by the breaching pin. Once the reservoir bag is pierced, ink can flow from the reservoir to flow into a standpipe region 530, and thence through a filter screen or capillary valve 518 and into the fluid manifold 536, which feeds the print head 516.

Though not shown, this embodiment can also include air passageways to accommodate the free flow of air that is displaced by the internal movement of the fluid reservoir 514. Once the reservoir has been breached, pressure can be regulated in a variety of ways. For example, backpressure control can be maintained by foam placed either in the reservoir or outside the reservoir within the housing 512. Alternatively, an active back pressure control system (not shown) can be located in the control unit for the print cartridge (not shown) to maintain the back pressure. This approach can include a fluid connection between the volumes above and below the reservoir, such as a hollow rib in the outer container.

Other options for creating this air passage can also be used. For example, the relative shapes of the reservoir and the housing can be selected to ensure a gap between the two at some point to allow air flow. For example, the reservoir can be circular in cross-section, while the housing is elliptical, oval or some other shape in cross-section. Additionally, an internal or external hollow rib can be provided in the housing to allow air to move freely. These various approaches generally assume that the top of the cartridge provides an open fluidic connection to the controller.

It is to be understood that, while the embodiment of FIGS. 12 and 13 has a different shape and configuration for the standpipe region 530 and print head die 516 compared to those shown in the other figures herein, this is just one of many possible embodiments of fluid ejection devices that can be configured in accordance with the present disclosure.

Advantageously, at manufacture the print head fluidic architecture can be filled with a non-ink keeper fluid, to which the print head materials are substantially inert. That is, a non-ink keeper fluid can be provided in the print head fluid passageways during manufacture, this fluid to remain during testing, storage, and shipping of the print cartridge, before the isolator mechanism is used to introduce ink or other fluid therein. In one embodiment, the keeper fluid can be air or some other gas. This gas is then removed in the manner discussed below after the fluid reservoir is breached, allowing the ink or other fluid to be ejected to displace the keeper fluid within the print head die and related passageways. Alternatively, a liquid keeper fluid can be used. The replacement of a liquid keeper fluid, rather than air, with ink as it is introduced to the print head fluidic architecture can be accomplished with less risk of air bubbles being introduced or trapped in the print head. Air bubbles can compromise the performance of the print head by creating barriers to ink flow, causing fluid ejection nozzles to be starved of ink or other fluid to be ejected.

The keeper fluid can be any one of many types of fluids that do not have substantial adverse effect on the print head materials, and that have physical and chemical properties (e.g. viscosity, pH, etc.) that allow the fluid to be completely displaced by ink during priming. It can also desirable that the keeper fluid be immiscible, or have limited solubility, with the ink or other fluid to be ejected, so that substantial mixing of the ink or other fluid with the keeper fluid does not occur during priming. It can also be desirable that varying concentrations of ink (or other fluid) and keeper fluid, if mixed, remain jetable (i.e. can be ejected from the print head), that the keeper fluid and fluid to be ejected not form precipitates or agglomerations that can obstruct the fluidic architecture of the print head, and that the keeper fluid and fluid to be ejected do not chemically react together. Possible keeper fluids include air, as mentioned above, and liquids such as mixtures of water and di-ethylene glycol (e.g. 5%-25% by weight), water and glycerol (e.g. 5%-25% by weight), and water and 1.5 pentanediol (e.g. 5%-25% by weight). Other keeper fluids can also be used.

One advantage of using a liquid keeper fluid is that a liquid keeper fluid can allow for quality testing of the print head during the manufacturing process. This is commonly done with ink-filled cartridges, where fluid is ejected from the print head nozzles to test the function of the internal electronics. In such a case the cartridge can eject a portion of the keeper fluid, rather than ink or other potentially harmful fluid, allowing the operation of the cartridge to be evaluated without bringing the potentially damaging fluid in the reservoir into contact with the print head.

Where a keeper fluid is used, the print cartridge is supplied to the user with the ink and print head internally separated, as discussed above. The user then primes the print head to purge the non-ink keeper fluid from the cartridge, and cause the ink to fill the print head. Priming of the print head can be done in several ways. In general, to prime the print head with ink, a measured amount of fluid is drawn through the ink ejection nozzles until ink (or other fluid to be ejected) fills the print head fluidics. In one embodiment, this is done by orienting the cartridge with the print head die and nozzles pointed up (i.e. generally inverted from the orientation shown in FIG. 1) but at a slight angle, such as 10-30 degrees relative to a vertical axis of the cartridge. The user then applies a slight vacuum to the print head nozzles (e.g. 10-30 in. $H_2O$), then operates the isolating mechanism (e.g. by breaching a membrane or opening a valve, as discussed above) to expose the ink supply to the print head fluid passageways. Once this has been achieved, the vacuum pressure draws the keeper fluid through the standpipe and manifold into the print head, expelling the keeper fluid through the nozzles until the keeper fluid is substantially completely displaced by the ink or other fluid from the reservoir. This method can be used where the keeper fluid is air.

Where a liquid keeper fluid is used, this fluid can be either "spit" out or drawn out by vacuum pressure. These actions can be done before the cartridge is installed in the print device (e.g. by vacuum pressure as described in the preceding paragraph), or the print device can be configured to perform a spitting action after the cartridge has been installed. Once the ink or other fluid from the fluid supply has arrived at all of the nozzles, the vacuum pressure can be removed, and the cartridge is ready for use. It can be desirable to use a keeper fluid that has a discernibly different appearance from the ink or other fluid, so that a user can readily determine when the keeper fluid has been completely purged, or to facilitate automated sensing of keeper fluid replacement completion. Should residual keeper fluid remain in the area of the nozzles after the priming operation is discontinued and the cartridge is installed for use, the print head electronics can be activated to eject the residual fluid by process typically known as "spitting."

Once the print head is primed with ink, the chemical or physical instability of print head materials can begin to cause changes within the print head, which may eventually cause it to fail. The nature of the failure and the time until the failure occurs are functions of the materials and construction used in the print head, the chemical composition of the ink or other fluid, and environmental factors, such as temperature, which can accelerate chemical reactions leading to print head instability and failure. It is desirable when selecting materials to be used in the construction of the print head, and in the specification of inks to be used, that the service life of the print head be sufficiently predictable so that it can be replaced before failing while in use.

The fluid ejection cartridge disclosed herein thus provides a print head and fluid supply that are isolated from each other at the point of manufacture and subsequent shipping and storage, and are then brought together later, just before use in a printing device. When manufactured, the fluid is separated from the print head by any of a number of structures such as a membrane or valve. This helps mitigate any negative impact on the print head that could be caused by exposure to the fluid during the period between manufacturing and use. The breaching of the isolator mechanism allows the fluid to enter the print head through the fluidic channels. This causes the fluid supply to be connected to the print head, allowing the fluid to displace the keeper fluid with which the cartridge is provided to the user.

This fluid ejection cartridge allows the use of a wide variety of fluids such as organic solvent-based inks and other fluids with potentially damaging chemical compositions, without requiring the difficult and expensive development of print heads made of materials that are highly stable when in contact with those fluids. In the hands of a user, the print cartridge is simple to activate, install, and use. It will last for a predictable predetermined period once activated by priming the print head with fluid since the point in time at which any reaction between fluid and print head materials begins is controlled and known. The simplicity of use reduces the risk of ink spills, leaks and human exposure, which is particularly desirable with organic solvent-based inks or other fluids, which are often classified as hazardous materials.

At the same time, it is to be appreciated that a fluid ejection cartridge with an isolated fluid supply configured in accordance with the present disclosure can also be used where the fluid is not believed to be potentially damaging to the print head. For example, a print cartridge containing a water-based ink that is not considered to be hazardous to the print head structure can nevertheless be provided with an isolated fluid reservoir and isolator mechanism that separate the fluid from contact with the print head until the isolator mechanism is breached.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A fluid ejection cartridge, comprising:

a print head, having a plurality of fluid ejection nozzles;

a fluid reservoir to hold a fluid to be ejected from the print head; and a selectively breachable isolator mechanism, separating the fluid reservoir and the print head, wherein the selectively breachable isolator mechanism comprises a rotatable valve having a selectively rotatable member, moveable from a first position in which the reservoir is fluidically separated from the print head, and a second position in which the fluid to be ejected is allowed to flow from the reservoir to the print head.

2. A fluid ejection cartridge in accordance with claim 1, further comprising a keeper fluid, disposed adjacent to the print head and outside the reservoir, the keeper fluid being displaceable by the fluid to be ejected after the selectively breachable isolator mechanism is breached.

3. A fluid ejection cartridge for an inkjet printer, comprising:

a unitary cartridge body, including a print head, having fluid passageways and a plurality of ink ejection nozzles;

an ink reservoir to hold ink; and a selectively breachable isolator mechanism, separating the ink reservoir from the print head to prevent contact between the ink and the print head prior to breaching of the isolator mechanism, wherein the selectively breachable isolator mechanism comprises a breachable membrane bounding a portion of the reservoir, and a breaching mechanism to selectively breach the breachable membrane to allow fluid from the reservoir to flow into the print head, wherein the breaching mechanism comprises a cutting member positioned adjacent to the breachable membrane to breach the membrane, wherein at least a portion of the cutting member is contained within the reservoir to pierce the membrane from inside the reservoir.

4. A fluid ejection cartridge in accordance with claim 3, further comprising a keeper fluid, within the cartridge, outside the reservoir, the keeper fluid being displaceable by the ink after breaching of the selectively breachable isolator mechanism.

5. A fluid ejection cartridge, comprising:

a body, having a print head with a plurality of nozzles for ejecting a fluid;

a fluid reservoir, inside the body to hold the fluid to be ejected in isolation from the print head prior to operation of the fluid ejection cartridge a selectively breachable isolator mechanism to allow the fluid to be ejected to flow to the print head; and a non-ink keeper fluid, disposed adjacent to the print head and outside the reservoir to isolate the print head from the fluid to be ejected until displacement of the non-ink keeper fluid, the non-ink keeper fluid being displaceable by the fluid to be ejected after the selectively breachable isolator mechanism allows the fluid to be ejected to flow to the print head.

6. A fluid ejection cartridge in accordance with claim 5, wherein the selectively breathable isolator mechanism is selected from the group consisting of a valve and a breachable membrane and cutting member, the breachable membrane bounding at least a portion of the reservoir, and the cutting member being moveable relative to the membrane, to thereby breach the breachable membrane.

7. A fluid ejection cartridge in accordance with claim 6, wherein the selectively breachable isolator mechanism comprises a valve, the valve comprising a rotatable valve having a selectively rotatable member, moveable from a first position in which the reservoir is fluidically separated from the print head, and a second position in which the fluid to be ejected is allowed to flow from the reservoir to the print head.

8. A fluid ejection cartridge in accordance with claim 6, wherein the selectively breachable isolator mechanism comprises a valve, the valve comprising a slidable valve having a slide that is moveable from a first position in which the reservoir is fluidically separated from the print head, and a second position in which fluid is allowed to flow from the reservoir to the print head.

9. A fluid ejection cartridge in accordance with claim 6, wherein the selectively breachable isolator mechanism comprises a breathable membrane and a cuffing member, wherein at least a portion of the cutting member is contained within the reservoir to pierce the membrane from inside the reservoir.

10. A fluid ejection cartridge in accordance with claim 6, wherein the selectively breachable isolator mechanism comprises a breathable membrane and a cutting member, wherein the cutting member is insertable from outside the cartridge to breach the membrane.

* * * * *

UNITED STATES PATENT AND TRADEMARK OFFICE

CERTIFICATE OF CORRECTION

PATENT NO. : 8,678,571 B2
APPLICATION NO. : 13/121719
DATED : March 25, 2014
INVENTOR(S) : William R. Wagner et al.

It is certified that error appears in the above-identified patent and that said Letters Patent is hereby corrected as shown below:

In the Claims:

In column 13, line 26, in Claim 6, delete “breathable” and insert -- breachable --, therefor.

In column 14, line 20, in Claim 9, delete “breathable” and insert -- breachable --, therefor.

In column 14, line 20, in Claim 9, delete “cuffing” and insert -- cutting --, therefor.

In column 14, line 25, in Claim 10, delete “breathable” and insert -- breachable --, therefor.

Signed and Sealed this
Twenty-eighth Day of October, 2014

Michelle K. Lee

Michelle K. Lee
*Deputy Director of the United States Patent and Trademark Office*